United States Patent [19]

Heinlein

[11] 4,206,771

[45] Jun. 10, 1980

[54] STYLING COMB

[75] Inventor: William K. Heinlein, Lakewood, Calif.

[73] Assignee: Hi-Line Inc.,, La Mirada, Calif.

[21] Appl. No.: 907,680

[22] Filed: May 19, 1978

[51] Int. Cl.[2] ..... A45D 24/00

[52] U.S. Cl. ..... 132/11 R

[58] Field of Search ..... 132/11 R, 125, 137, 132/191–192

[56] References Cited

U.S. PATENT DOCUMENTS

| | | | |
|---|---|---|---|
| 2,028,588 | 1/1936 | Carson | 132/125 |
| 2,292,494 | 8/1942 | Tupper | 132/125 |
| 3,792,707 | 2/1974 | Tupper | 132/11 R |
| 4,026,307 | 5/1977 | Morrow | 132/11 R |

*Primary Examiner*—G. E. McNeill

*Attorney, Agent, or Firm*—Poms, Smith, Lande & Rose

[57] ABSTRACT

A styling comb comprising a plurality of teeth equally spaced approximately 0.25 inches apart, eleven such teeth being disposed along a linear extent of approximately 0.075 inches in overall thickness at their apices.

8 Claims, 4 Drawing Figures

STYLING COMB

BACKGROUND OF THE INVENTION

1. Field of the Invention

The invention relates to combs; and, more particularly, to a high texturizing comb for styling hair.

2. Description of the Prior Art

Various types of combs are well known in the art. Although they all have specific areas of use, there is a need for a comb which can stylize today's modern hairdos. There is a need for such a comb which provides a high texturing effect to the hair of the user to give it body.

SUMMARY OF THE INVENTION

It is an object of this invention to provide a styling comb having eleven teeth spaced approximately 0.25 inches apart along a linear extent of approximately 2.075 inches, the teeth being approximately 0.075 inches in overall thickness.

It is still another object of this invention to carry out the foregoing object wherein the teeth are generally triangular in a cross-section and taper to a flattened point.

These and other objects are preferably accomplished by providing a comb having a plurality of teeth equally spaced approximately 0.25 inches apart, eleven such teeth being disposed along a linear extent of approximately 2.075 inches, the teeth being approximately 0.075 inches in overall thickness at their apices.

DESCRIPTION OF THE PREFERRED EMBODIMENT

Figure 1:
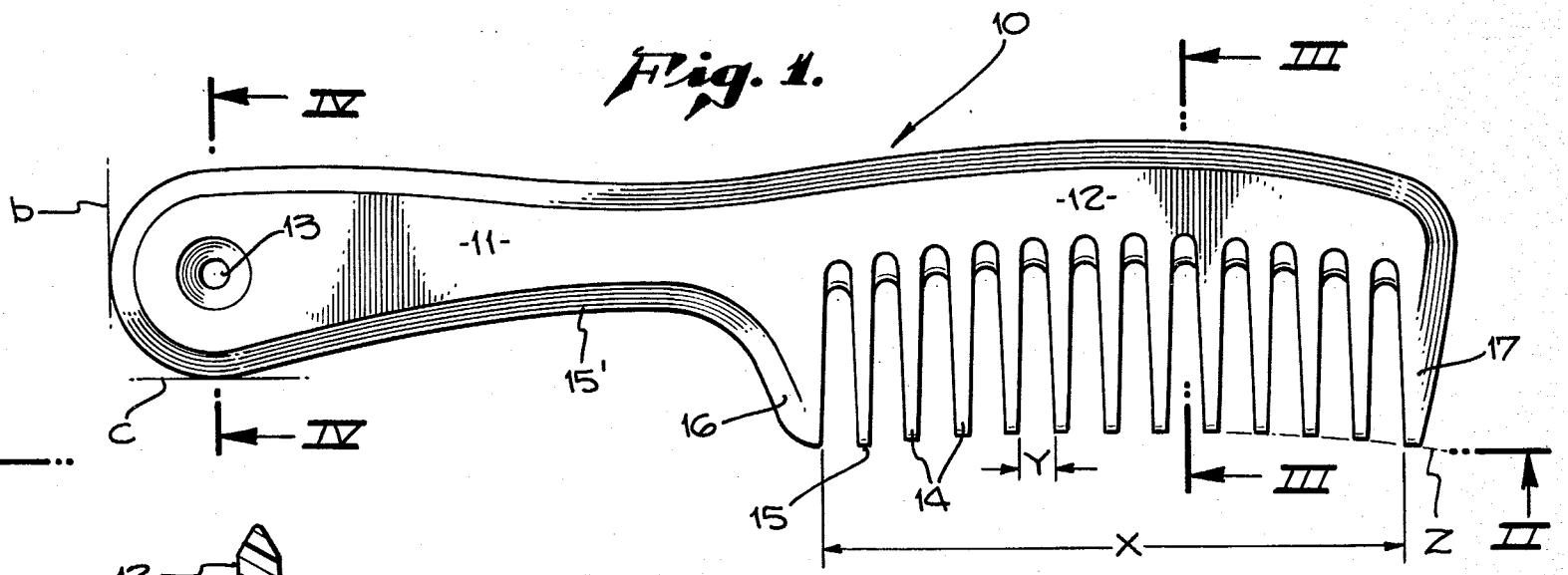
FIG. 1 is a vertical view of a styling comb in accordance with the teachings of my invention.
Figure 4:
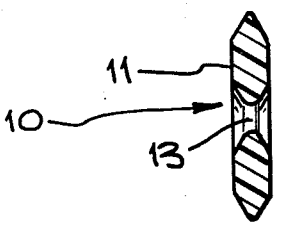
FIG. 4 is a cross-sectional view taken along lines IV—IV of FIG. 1.

Referring now to FIG. 1 of my invention, a styling comb 10 is shown having a handle portion 11 and a toothed portion 12. Handle portion 11 includes an aperture 13 for hanging comb 10 in a suitable location. Toothed portion 12 included a plurality of equally spaced teeth 14.

Figure 3:
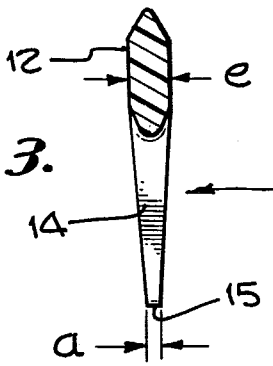
FIG. 3 is a cross-sectional view taken along lines III—III of FIG. 1.

As particularly contemplated in the present invention, eleven such teeth 14 are disposed within the linear extent X. This linear extent is approximately 2.075 inches. Each tooth 14 is spaced a distance y of approximately 0.25 inches apart. Although this distance may vary, e.g., between about 0.20 and 0.30 inches, 0.25 inches is preferred. Also, each tooth 14, as shown in FIG. 3, is generally triangular in cross-section with a flattened apex or tip 15. These tips 15 terminate along an arcuate plane z, as shown in FIG. 1, to follow generally the curvature of the head of a user. The width of each tip 15, as seen in FIG. 3, is approximately 0.075 inches.

Figure 2:
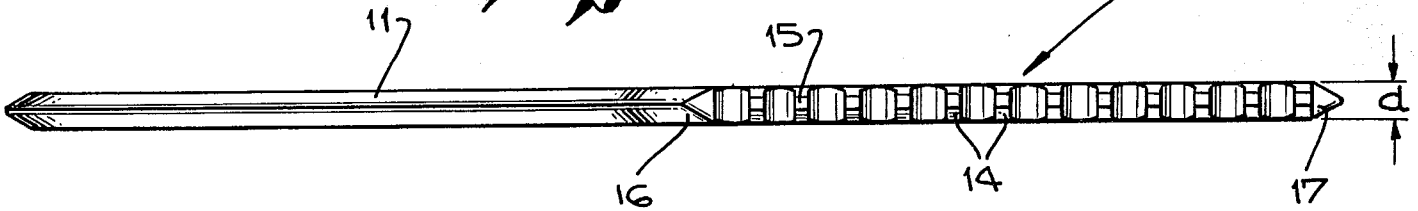
FIG. 2 is a view taken along lines II—II of FIG. 1.

The overall length of comb 10 is preferably about 9" with aperture 13 about 0.200 inches in diameter and located about 0.7 inches from tangent lines b and c. The overall thickness d of the comb 10, as seen in FIG. 2, is preferably about 0.300 inches. Thus, each tooth 14 has a base width e (FIG. 3) about 0.300 inches, tapering gradually to tip 15 to a width of about 0.075 inches.

Each tooth 14 may be about 1⅛" in length (varying slightly due to the curvature of plane z, the preferred overall width of comb 10 being about 1-15/16".)

The area 15' of comb 10 (FIG. 1) is curved to conform to the user's hand, terminating at a generally triangular wall 16, which, with generally triangular end wall 17, comprises the linear limits for teeth 14 equally spaced therebetween.

The spacing and configuration of the teeth 14 of comb 10 results in a very effective styling comb for texturizing hair. Although some deviation from the exact spacing and dimensions is possible, I have found that the most effective comb is one that has eleven teeth along a linear extent of 2.075 inches equally spaced about 0.25 inches apart.

I claim:

1. In a styling comb adapted to be pulled through the hair of a user having a handle portion and an integral toothed portion, the invention which compromises:

said toothed portion includes eleven teeth along a linear extent of approximately 2.075 inches, each of said teeth being generally trapezoidally shaped and generally symmetrical about its longitudinal axis in a plane perpendicular to the direction of movement of the comb through the hair of a user, each of said teeth having its widest cross section integral with and extending from said toothed portion and its smallest cross-section at its terminal end, all of said teeth terminating in flattened apices lying in a common arcuate plane, said teeth being equally spaced from each other approximately 0.25 inches with the widest portion of each of said teeth being about 0.3 inches in thickness and the apex of each of said teeth being about 0.075 inches in thickness.

2. In the comb of claim 1 wherein each of said teeth are generally triangular in cross-section having its widest portion integral with and extending from said toothed portion and terminating at a flattend apex.

3. In the comb of claim 2 wherein said widest portion of said teeth is about 0.3 inches, and said apex is about 0.075 inches.

4. In the comb of claim 1 wherein each of said teeth is approximately 1⅛ inches in overall length.

5. In the comb of claim 1 wherein all of said teeth terminate in apices lying in a common arcuate plane.

6. In the comb of claim 1 wherein said handle portion includes an aperture extending therethrough.

7. In the comb of claim 1 wherein said comb is approximately 9 inches in overall length.

8. In the comb of claim 7 wherein said comb is approximately 1-15/16 inches in overall width.

* * * * *